US006161608A

United States Patent [19]

Pleschiutschnigg

[11] Patent Number: 6,161,608

[45] **Date of Patent: *Dec. 19, 2000**

[54] METHOD AND APPARATUS FOR PRODUCING COATED SLABS OF METAL, PARTICULARLY STRIPS OF STEEL

[75] Inventor: Fritz-Peter Pleschiutschnigg, Duisburg, Germany

[73] Assignee: SMS Schloemann-Siemag Aktiengesellschaft, Dusseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/934,952

[22] Filed: Sep. 22, 1997

[30] Foreign Application Priority Data

Sep. 23, 1996 [DE] Germany ..... 196 38 906

[51] Int. Cl.[7] ..... B22D 11/00; B05D 1/18

[52] U.S. Cl. ..... 164/461; 164/419

[58] Field of Search ..... 164/461, 419; 427/431, 434.7, 436

[56] References Cited

U.S. PATENT DOCUMENTS 3,235,960 2/1966 Carreker, Jr. ..... 164/461

3,709,722 1/1973 Corrigan et al. .

FOREIGN PATENT DOCUMENTS 4319569 6/1994 Germany .

195 09 681 C1 5/1996 Germany .

195 09 691 C1 5/1996 Germany .

1-201453 8/1989 Japan ..... 164/461

94/29048 12/1994 WIPO ..... 164/461

*Primary Examiner*—Kuang Y. Lin

*Attorney, Agent, or Firm*—Friedrich Kueffner

[57] ABSTRACT

A method and apparatus forproducing coated slabs of metal, particularly strips of steel, in which a metal slab is guided through the bottom of a vessel filled with molten metal having the same or different composition as the metal slab, wherein the dwell time of the metal slab is selected in dependence on the melting bath level, the casting speed, the metal slab thickness and the preheating temperature of the metal slab in such a way that the molten metal deposited on the metal slab has a desired thickness of a multiple of the initial thickness of the metal slab, and wherein the metal slab with the layer crystallized onto the metal slab is subjected to a smoothing pass after emerging from the melting bath. The smoothing pass is carried out when the surface temperature of the crystallized slab is smaller than the solidus temperature of the melting bath and, thus, at least the surface of the crystallized layer is solidified.

10 Claims, 3 Drawing Sheets

METHOD AND APPARATUS FOR PRODUCING COATED SLABS OF METAL, PARTICULARLY STRIPS OF STEEL

BACKGROUND OF THE INVENTION

1. Field of the Invention

The present invention relates to a method of producing coated slabs of metal, particularly strips of steel, in which a metal slab is guided through the bottom of a vessel filled with molten metal having the same or different composition as the metal slab, wherein the dwell time of the metal slab is selected in dependence on the melting bath level, the casting speed, the metal slab thickness and the preheating temperature of the metal slab in such a way that the molten metal deposited on the metal slab has a desired thickness of a multiple of the initial thickness of the metal slab, and wherein the metal slab with the layer crystallized onto the metal slab is subjected to a smoothing pass after emerging from the melting bath. The present invention also relates to an apparatus for carrying out the method.

2. Description of the Related Art

The method and apparatus of the type described above are generally used for producing coated metal slabs which are thinly coated with stainless steels, preferably strips of a steel of one steel quality or different steel qualities, for example, single-component materials or composite materials, particularly also composite materials of carbon steel.

DE 195 09 691 C1 discloses an inversion casting vessel and a method of producing thin metal slabs, particularly of steel, in which a metal strip is guided through the bottom of a vessel filled with melt and is pulled off after metal has crystallized onto the strip. The metal strip is conveyed guided by guide rolls through a duct to the melt in the container. After a layer of molten metal has crystallized onto the strip, the strip is conveyed above the vessel through smoothing rolls in which the strip with the layer crystallized thereon is smoothened to dimensions which are close to the final dimensions.

DE 195 09 681 C1 discloses another inversion casting device and a method for continuously producing strip-shaped sheet metal, particularly of steel, in which a core strip is guided through a melting bath of a metal in order to achieve a certain form of crystals and molten metal which deposit on the surface of the core strip. After the core strip has left the melting bath, the crystallized coating is advantageously immediately smoothened by means of a pair of smoothing rolls which are arranged above the melting bath.

However, the inversion casting devices are discussed in the two references mentioned above primarily with respect to the seal of the vessel relative to the entering strip in such a way that the melting bath is intensively cooled in the area of the slot like entry opening for the core strip in such a way that a temperature drop occurs in the meniscus wherein the two-phase area of melt/crystal has such a high viscosity that the meniscus assumes the function of a seal which renews itself. In view of this background, the two references mentioned above do not provide any indication concerning an optimum manner of carrying out the method and optimization of the surface of the produced strip when being treated by the pair of smoothing rolls.

DE 43 19 569 C1 discloses a method of producing strip material of metal and an apparatus for carrying out the method in which a sheet thickness tolerance of at most 2% can be maintained. For this purpose, the semifinished product having a width/thickness ratio of above 60 is subjected to a smoothing pass after leaving the melting bath. When the smoothing pass is carried out, the steel strip has a "pasty" surface (2 phases: melt and crystal) in accordance with the example and the formula T=T,sol+ax (T,li−T,sol), with 0.5 being selected for a, wherein the deposited layer has an average temperature of T=1497° C.+0.5×(1507° C.−1497° C.)=1502° C.). This condition means that the steel strip is still "pasty" at its surface when entering the pair of smoothing rolls, i.e., the steel strip is still in the two-phase area, i.e., liquid/solid, and, thus, does not have a purely solid phase.

This method condition of a crystallized layer with a "pasty surface and pasty core" has the disadvantage that the layer adhering to the core strip is already solidified to a relatively significant extent, on the one hand, while still having in its outer zone sufficient portions of liquid phase when entering the pair of smoothing rolls, on the other hand, so that the strip is significantly undercooled when travelling though the pair of smoothing rolls and, thus, there is the tendency of the formation of cracks in longitudinal direction as well as in transverse direction of the strip. This danger occurs increasingly with increasing casting and rolling speeds.

SUMMARY OF THE INVENTION

Therefore, it is the primary object of the present invention to provide a method and an apparatus of the above-described type which make possible a smoothing of the strip with a sheet thickness tolerance of at most 2% without the formation of cracks either in the surface as well as in the interior of the strip.

In accordance with the present invention, the smoothing pass is carried out when the surface temperature of the crystallized slab is smaller than the solidus temperature of the melting bath and, thus, at least the surface of the crystallized layer is solidified.

The apparatus for carrying out the method according to the present invention includes a melt vessel or crystallizer having a bottom, wherein a core strip is introduced by means of a pair of drive rolls through the bottom in the area of a bottom inlet device so as to form a meniscus. Arranged in a space above the melting bath are a pair of smoothing rolls with a roll gap for conducting therethrough the metal slab with a crystallized layer which is solidified at the surface thereof. The walls of the space above the melting bath and the pair of smoothing rolls are constructed so as to be heatable in a controlled manner.

The method and apparatus according to the present invention make it possible to produce flawless strips with planar coatings, for example, having a width to thickness ratio of greater than 60 and a total thickness of at most 12 mm, preferably 2–6 mm, from a material or from composite materials of different metal qualities, for example, carbon steel in the form of a single-component material or carbon steel with a stainless steel coating of at least 5% of the total strip thickness as a composite material and a thickness deviation of at most 2% between the edge (40 mm from the edge) and the middle of the strip.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
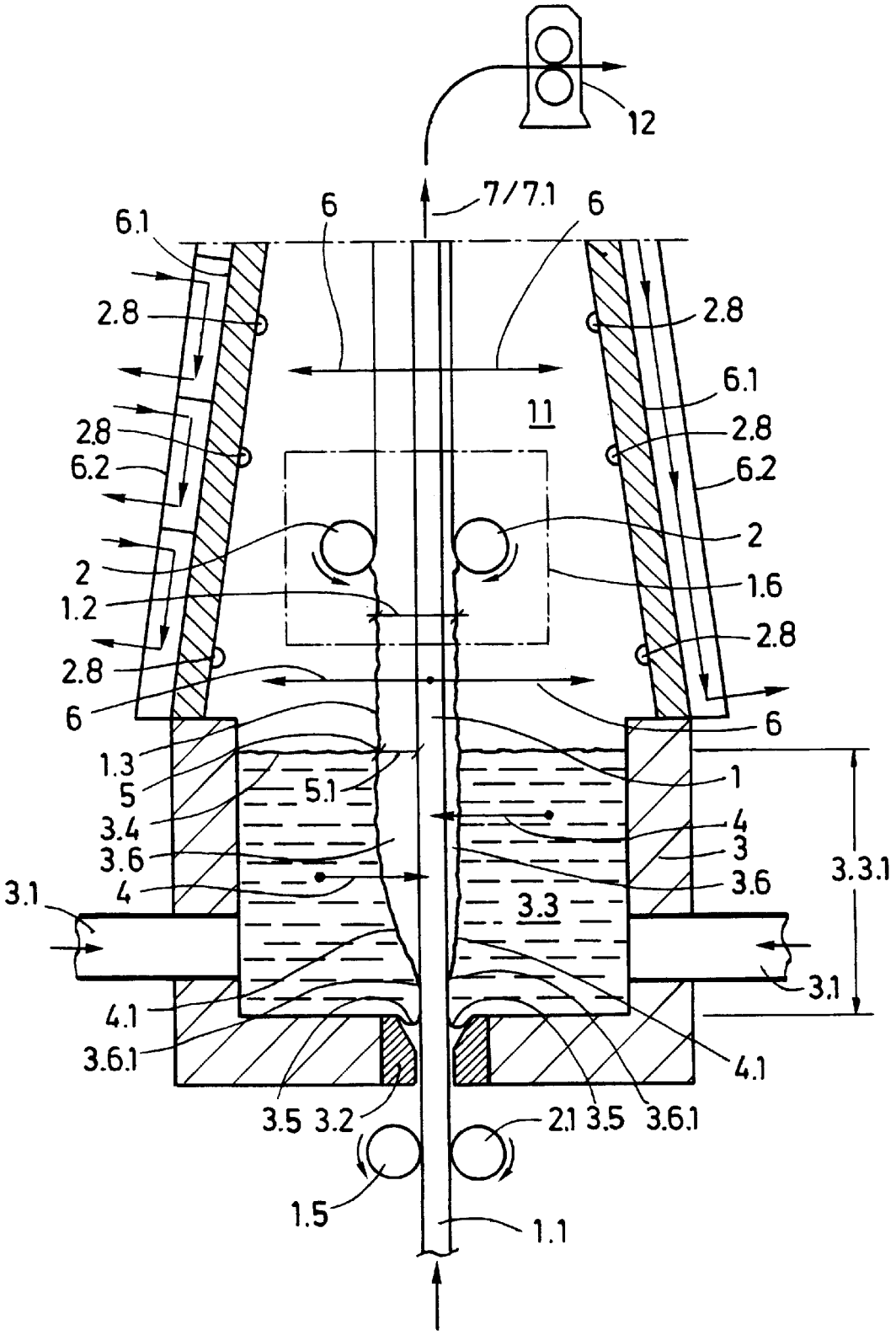
FIG. 1 is a schematic sectional view showing the apparatus according to the present invention for smoothing coated slabs of metal, preferably strips of steel.
Figure 2:
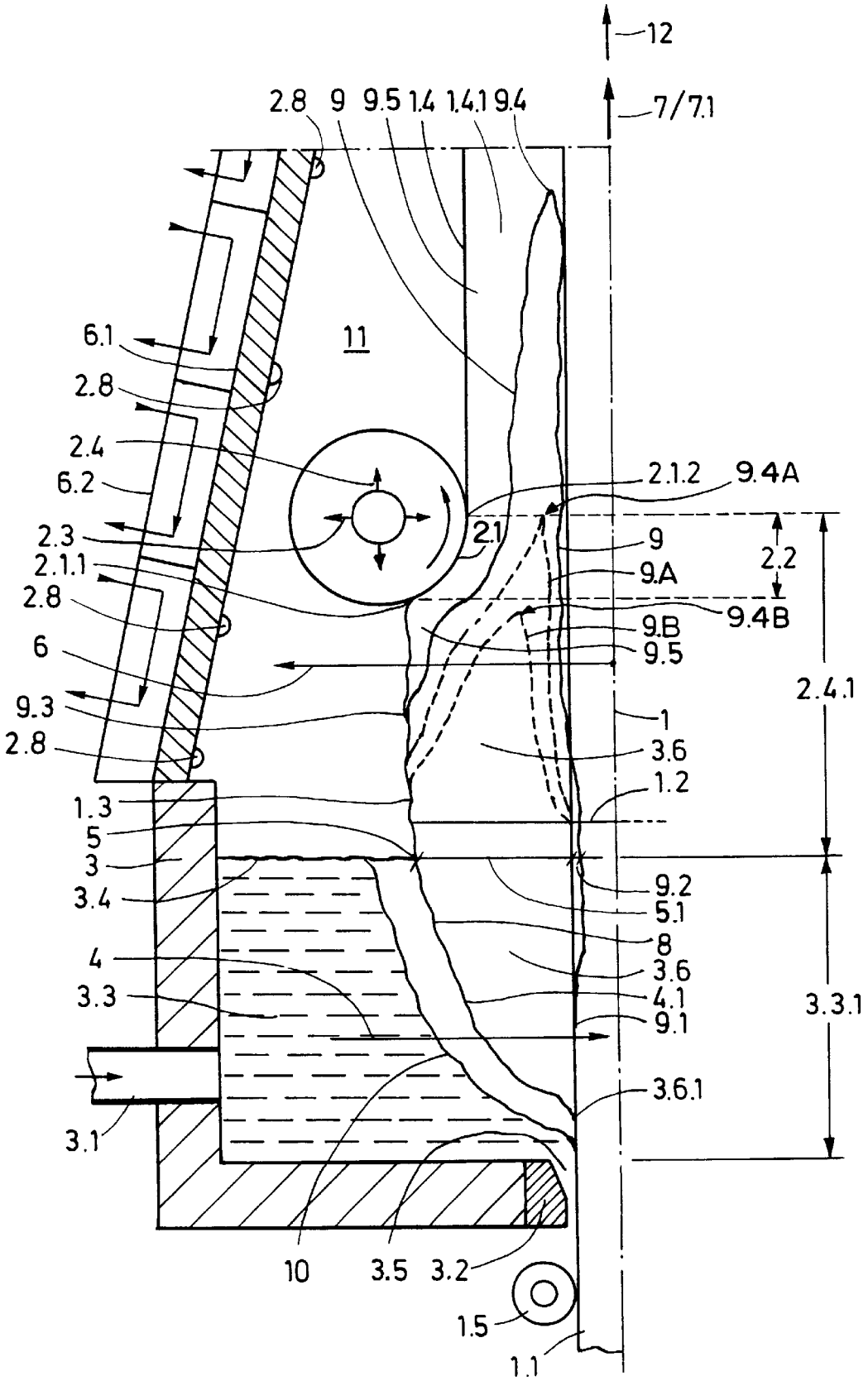
FIG. 2 is a schematic illustration, on a larger scale, showing the temperature pattern of the slab between the entry of the slab in the crystallizer and the pair of smoothing rolls during casting.

FIGS. 1 and 2 of the drawing show the apparatus according to the present invention for smoothing coated slabs, preferably strips of steel 1, by means of a pair of smoothing rolls 2. A core strip 1.1 is conveyed with a casting and rolling speed 7.1 of 0.05–10 m/s through the nozzle of a bottom inlet device 3.2 by means of a pair of drive rolls 1.5 arranged underneath the crystallizer 3. The crystallizer 3 is filled with melt 3.3 which is introduced through a melt inlet 3.1.

The core strip 1.1, having a temperature of optionally 20° to 800° C. before entering the crystallizer 3, begins above the steel meniscus 3.5 formed at the nozzle outlet 3.2 with the crystallization 3.6 of melt in point 3.6.1 and removes superheating and crystallization energy from the melt 3.3 while simultaneously being heated. This energy flow 4 from the melt into the core strip takes place as the core strip travels through the melting bath 3.3 between the meniscus 3.5 and the bath surface 3.4 along the height 3.3.1 of the melting bath. When the coated strip 1 emerges at 5 from the bath surface 3.4 of the melting bath with a surface roughness 1.3, the strip has reached a certain thickness 1.2 which is a multiple of the initial thickness of the metal slab (see FIG. 1) and with which the strip 1 enters the roll gap 1.2 of the pair of smoothing rolls 2, wherein the thickness 2.1 is determined essentially by the strip temperature as it enters the crystallizer, by the melt temperature and the contact time of the strip with the melt.

The strip 1 coated in this manner has when emerging at 5 from the bath 3.4 a surface with a "pasty" consistency (two phases: melt and crystal) and has a surface roughness 1.3 of greater than 2% which does not meet the planeness criteria of a strip having a width/thickness ratio of greater than 60.

After the coated strip 1 leaves the bath 3.4 with the final thickness 5.1, the solidification takes place between the point 5 and the pair of smoothing rolls 2 and beyond in the crystallized layer composed of melt and crystal from the outside toward the inside, i.e., the energy flow 6 is reversed as compared to the heat flow 4 in the melt 3.3 and takes place from the inside (strip middle) toward the outside in the walls 6.1 whose heat conduction can be controlled. The wall elements 6.2 make it possible to carry out the controlled heat flow in zones in the casting and rolling direction 7 as they are necessary for the temperature pattern of the strip 1. These features of the apparatus according to the present invention make it possible to control the heat flow 6 from the strip to the walls 6.1 and 6.2 whose heat conduction can be controlled, or to regulate the heat flow 6 in dependence of the steel quality, the casting speed 7.1 and the position 2.4 of the pair of smoothing rolls 2.

The unexpected solution provided by the present invention requires control of the temperature fields in the apparatus and, thus, of the temperature-related phase stages of the coated strip 1. The temperature fields are defined by the heat flow 4 from the melt 3.3 into the core strip 1.1; the heat flow 6 from the coated strip 1 into the walls 6.1, 6.2, providing controlled heat transfer, in the area between the bath surface 3.4 and the pair of smoothing rolls 2 and in the area above the smoothing rolls 2; and the heat flow from the coated strip 1 in the roll gap 2.1 of the pair of smoothing rolls 2 via the roll bodies into, the internal cooling means 2.5.

The crystallization 3.6 in the bath 3.3 has on its surface 4.1 a temperature 8 of T-x which is higher than solidus temperature and lower than the liquidus temperature (T-li>T-x>T-sol) and has a two-phase state composed of melt and crystal. The temperature of this crystallization decreases steadily from the surface perpendicularly of the core strip 1.1. The liquidus isothermal line 10 extends in the melting bath to the bath surface 3.4 proportional to the surface profile 4.1 of the crystallization 3.6.

When the coated strip 1 emerges from the bath 3.4 at the point 5, the molten layer 9.2 of the core strip 1.1 is the greatest, wherein the increase of the layer 9.2 began in the melt bath 3.3 at the point 9.1 where the solidus temperature is reached. When the melting of the core strip begins, the welding between the core strip 1.1 and crystallized layer 3.6 starts.

Above the melt, the energy flow 6 is reversed and the solidification of the residual melt takes place in the crystallized layer, composed of the phases melt and crystal, from the surface of the strip 1 perpendicularly to the strip center. This energy loss occurs in the direction of the strip toward the pair of smoothing rolls parallel to the casting and rolling direction; in other words, the surface temperature of the strip drops steadily starting from the bath surface 3.4 at the point 5 in the direction toward the pair of smoothing rolls, reaches the solidus temperature in point 9.3 at the entry 2.1.1 of the coated strip 1 into the roll gap of the pair of smoothing rolls 2, where the surface temperature assumes a value which is below the solidus temperature.

For controlling a desired temperature pattern of the coated strip 1, the position 2.4 of the pair of smoothing rolls 2, the energy flow 6 into the walls 6.1 and 6.2 which can be heated, and the casting and rolling speed 7.1 are to be controlled in accordance with the present invention in such a way that the surface temperature of the coated strip 1 prior to entering the roll gap of the pair of smoothing rolls 2 is below the solidus temperature and thus, the coated strip is solidified at least at its surface.

This requirement is absolutely necessary for a crack-free surface because the solidified phase, particularly immediately below the solidification point, has a pronounced extension capability without the formation of cracks. In contrast to this good extension capability of the material steel immediately below the solidification point, i.e., the solidus temperature, it is known that the deformation limit in the "pasty" area, i.e., at the two-phase boundary melt/crystal is very small and, thus the capability of avoiding cracks is very small. Depending on the steel quality, the deformation limit is between 0.1 and 0.3%.

In steel qualities which are sensitive to internal cracks, i.e., steels which have the tendency to form cracks in the "pasty" area in the case of the smallest deformations, i.e., elongation loads, it is important in connection with the method according to the present invention that the solidification profile 9 at the phase boundary solid/liquid is controlled in such a way that the solidification 9.4 of the coated slab 1 is concluded at the latest at the exit 2.1.2 (illustrated by the solidification profile 9.A with solidification point 9.4A) of the roll gap of the pair of smoothing rolls 2, or at the latest at the entry 2.1.1 (illustrated by the solidification profile 9.B with solidification point 9.4B) into the roll gap of the pair of smoothing rolls 2.

These conditions of the coated strip 1 in the pair of smoothing rolls can be adjusted, with a predetermined casting speed 7.1, by means of the control of the heat flows 6 and 2.7 using the wall elements 6.1 and 6.2 and/or the pair of smoothing rolls 2 whose distance relative to the melting bath level 2.4.1 is adjustable and which are provided with internal cooling means 2.5.

By ensuring that the strip 9.5 is solidified at least in the surface area thereof in the roll gap 1.2 along the compressed length 2.2, when carrying out thickness reductions of up to 20% by adjusting the pair of smoothing rolls 2 in the thickness direction, it is now possible to roll or smoothen 1.4 the strip 1 with its rough surface 1.3 without the formation of surface cracks or internal cracks in the crystallized layer, while simultaneously ensuring a good welded connection between the core strip 1.1 and the crystallized layer 3.6. The planar strip 1.4.1 smoothened in this manner is free of cracks at its surface 1.4 and in the interior of its solidified crystallized layer 3.6. The planeness, or the profile of the strip 1.4.1 being produced, can be adjusted in accordance with the features of the present invention described above with a tolerance of at most 2% of the thickness in transverse direction and longitudinal direction.

Figure 3:
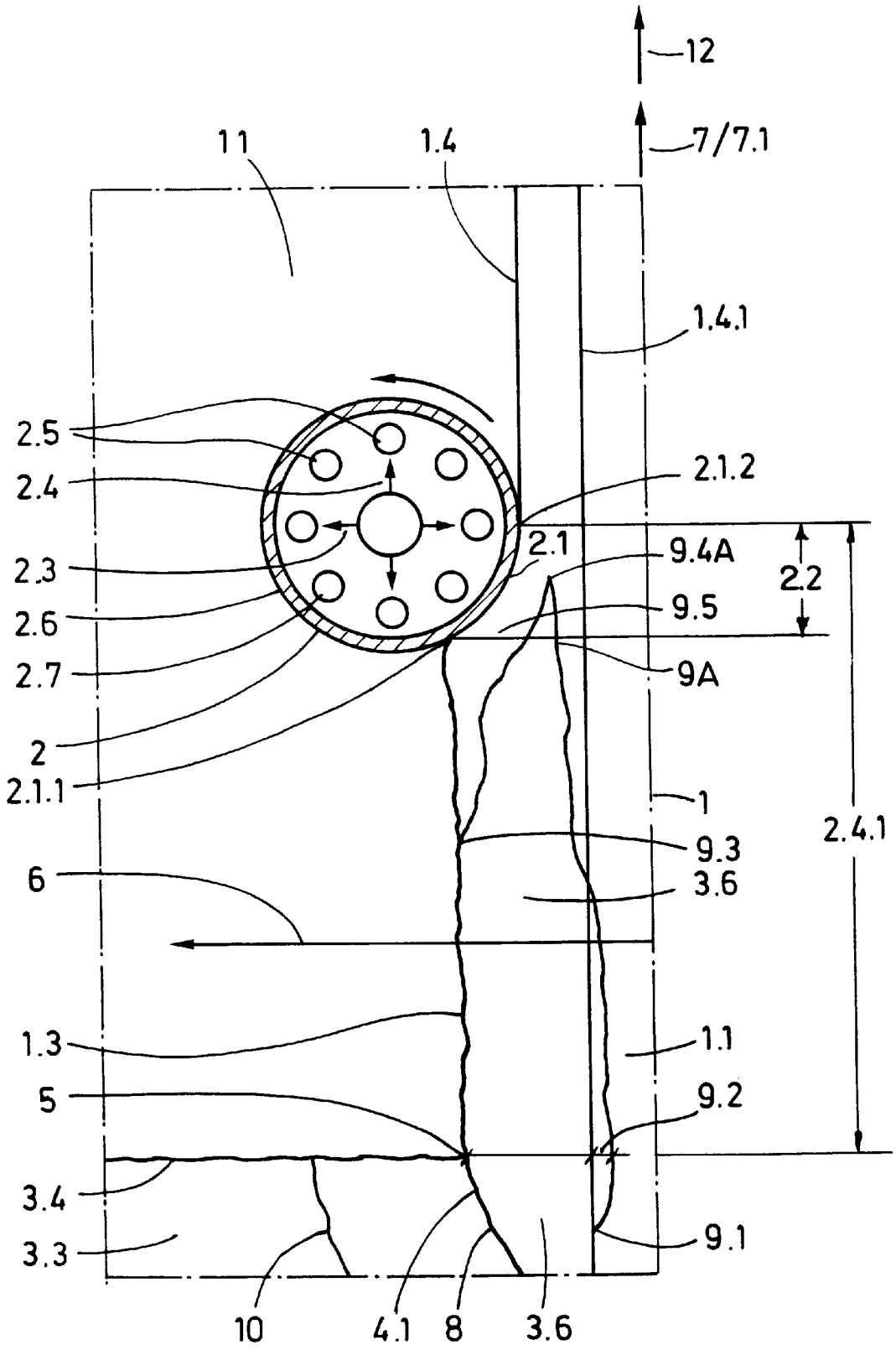
FIG. 3 is a schematic view, showing a detail of FIG. 1 on a larger scale, of a coated strip between the melting bath surface in the crystallizer and the pair of smoothing rolls.

FIG. 3 of the drawing shows the area of the pair of smoothing rolls 2 in somewhat greater detail. The coated strip 1 with its crystallized layer 3.6 enters the roll gap 2.1.1 with a surface temperature T-2.1.1 which is lower than the solidus temperature (T-2.1.1<T-sol) and emerges at the exit 2.1.2 of the roll gap 2.1 with a temperature which is lowered in a controlled manner, i.e., T-2.1.2 which is lower than T-2.1.1 (T-2.1.2<T-2.1.1<T-sol). The temperature loss in the roll gap should be controlled and kept small. In accordance with the present invention, this can be achieved by means of a pair of smoothing rolls 2 whose temperature can be controlled, wherein the smoothing rolls 2 are provided with an internal cooling means 2.5 and a heatable layer 2.6 or layers. The heat flow into the internally cooled pair of smoothing rolls 2 is indicated by 2.7.

For this purpose, the cooling means, the materials being processed and the diameter of the rolls 2, the layers 2.6 and the different roll materials, such as, steel, metal, metal ceramics, sintered ceramics and/or ceramics, must be appropriately selected.

The entire space 11 above the bath surface 3.4 is controlled with respect to temperature and atmosphere (nitrogen and/or argon), so that the above-described conditions are ensured and an oxidation of the strip surface is avoided.

The strip coated in the above-described manner is conveyed directly or indirectly to another rolling mill 12 and rolling process for producing finished hot-rolled strip and/or cold-rolled strip either in the form of a single material or a composite material, with or without pickling prior to rolling.

For monitoring, controlling and/or regulating the temperature field in the coated strip 1 and on the strip surface 1.3 between the melting bath level 3.4 and the exit of the coated and smoothened strip 1.4.1 from the pair of smoothing rolls 2, measuring devices are provided for temperature determination 2.8 at the inner side of the heat-controlled wall elements 6.2.

The invention is not limited by the embodiments described above which are presented as examples only but can be modified in various ways within the scope of protection defined by the appended patent claims.

I claim:

1. A method of producing coated slabs of metal, particularly strips of steel, the method comprising guiding a metal slab having an initial thickness through a bottom of a vessel filled with a melt bath having the same or different composition as the metal slab, wherein a dwell time of the metal slab in the melt bath is selected in dependence on a melt bath level, a casting speed of the slab, a metal slab thickness and a preheating temperature of the metal slab such that melt deposited on the metal slab has a desired thickness of a multiple of the initial thickness of the metal slab, subjecting the metal slab with a layer crystallized onto the metal slab to a smoothing pass after the metal slab emerges from the melting bath, further comprising carrying out the smoothing pass when a surface temperature of the crystallized slab layer is lower than the solidus temperature of the melt bath and only the surface of the crystallized layer is solidified.

2. The method according to claim 1, wherein the smoothing pass is carried out in a roll gap of a pair of smoothing rolls and wherein solidification of the crystallized layer occurs after the slab passes the roll gap due to heat flow from the crystallized slab layer to the smoothing rolls.

3. The method according to claim 1, wherein the smoothing pass is carried out in a roll gap of a pair of smoothing rolls and wherein solidification of the crystallized layer occurs in the roll gap due to heat flow from the crystallized slab layer to the smoothing rolls.

4. The method according to claim 1, comprising adjusting an energy flow above the melting bath level into heat-controllable walls of the vessel for controlling the solidification of the crystallized layer of the slab.

5. The method according to claim 1, wherein the smoothing rolls are internally cooled, comprising adjusting an energy flow through the roll gap into the smoothing rolls for controlling the solidification of the crystallized layer of the slab.

6. The method according to claim 1, comprising conveying the slab with crystallized layer after smoothing to a rolling process which is carried out in a controlled manner with respect to at least one of atmosphere and temperature.

7. The method according to claim 1, comprising cooling the slab with crystallized layer after smoothing in a manner which is carried out in a controlled manner with respect to at least one of oxidation-free atmosphere and temperature.

8. The method according to claim 1, comprising providing an oxidation-free atmosphere above the melting bath level during coating of the slab.

9. The method according to claim 1, comprising introducing the metal slab into the vessel with a rolling speed of 0.05 to 10 m/sec.

10. The method according to claim 1, comprising introducing the metal slab continuously and perpendicularly through the bottom of the vessel with a temperature of 20 to 800° C.

* * * * *